US008011171B2

(12) United States Patent
Repkin et al.

(10) Patent No.: US 8,011,171 B2
(45) Date of Patent: Sep. 6, 2011

(54) PORTABLE STORAGE APPARATUS

(76) Inventors: Vladi Repkin, San Diego, CA (US); Victor Repkin, San Diego, CA (US)

( * ) Notice: Subject to any disclaimer, the term of this patent is extended or adjusted under 35 U.S.C. 154(b) by 227 days.

(21) Appl. No.: 12/472,309

(22) Filed: May 26, 2009

(65) Prior Publication Data

US 2010/0300046 A1 Dec. 2, 2010

(51) Int. Cl.
*B65B 31/04* (2006.01)

(52) U.S. Cl. ..... 53/432; 53/485; 53/510; 62/371; 220/23.83; 220/89.1

(58) Field of Classification Search ..... 53/432, 53/485, 510; 62/371, 457.9, 458; 220/89.1, 220/420, 23.83
See application file for complete search history.

(56) References Cited

U.S. PATENT DOCUMENTS

| | | | | |
|---|---|---|---|---|
| 4,502,295 | A * | 3/1985 | Toledo-Pereyra | 62/463 |
| 5,103,651 | A * | 4/1992 | Coelho et al. | 62/341 |
| 5,263,518 | A * | 11/1993 | Ebbing | 141/7 |
| 5,285,657 | A * | 2/1994 | Bacchi et al. | 62/457.9 |
| 5,483,799 | A * | 1/1996 | Dalto | 62/3.7 |
| 5,918,478 | A * | 7/1999 | Bostic et al. | 62/371 |
| 5,934,099 | A * | 8/1999 | Cook et al. | 62/457.2 |
| 6,205,794 | B1 * | 3/2001 | Brothers | 62/51.1 |
| 6,209,343 | B1 * | 4/2001 | Owen | 62/457.2 |
| 6,244,458 | B1 * | 6/2001 | Frysinger et al. | 220/592.09 |
| 6,401,479 | B2 * | 6/2002 | Garrett | 62/371 |
| 7,040,115 | B1 * | 5/2006 | Lopez et al. | 62/457.2 |
| 2007/0032774 | A1 * | 2/2007 | Glade et al. | 604/403 |

* cited by examiner

*Primary Examiner* — Thanh Truong

(57) ABSTRACT

A portable storage apparatus for storing perishable items at a reduced temperature and under a reduced pressure is provided. The method of using the apparatus is also disclosed.

14 Claims, 3 Drawing Sheets

PORTABLE STORAGE APPARATUS

FIELD OF THE INVENTION

This invention relates generally to the field of storage containers. More specifically, the invention relates to a portable storage apparatus for storing and maintaining perishable items at reduced temperatures and under a reduced pressure.

BACKGROUND

Insulated containers, colloquially referred to as "coolers," are popular consumer items that are commonly and widely used for cooling, maintaining, and/or storing various items, such as food and drink. The insulated containers are typically portable, and are accordingly often used in a variety of outdoor settings, e.g., picnicking, camping, and the like. Other important applications stem from the frequently existing need to transport commercial goods such as perishable food, drink, medicine, and environmental samples. Finally, insulated containers find important uses in the medical industry, where they are used to move transplant organs and other articles that need to remain cold during transport and prior to use.

Various designs of a typical insulated container are well known. Commonly, a cooling medium (e.g., ice, ice water, etc.) is placed at the bottom of a container, and the items to be cooled, stored, and/or maintained are placed on top of the cooling medium. Thereafter, an additional amount of the cooling medium may be placed on top of the items, and/or on the sides. As a result, the items to be cooled, stored, and/or maintained are ensconced in the cooling medium and are cooled due to a direct contact with it.

While being helpful and useful in many respects, the existing portable storage containers are characterized by a number of drawbacks and deficiencies. The most obvious disadvantage is an inherently limited time during which the items can be maintained under a reduced temperature. Once the ice has melted and the resulting water's temperature has reached the ambient temperature, one can no longer obtain any advantage or benefit by using a cooler. In addition, in existing systems, the items that are being cooled are in direct contact with ice and/or ice water. As a result, the items or their outer wrapping inevitably become wet. This is often quite undesirable.

Accordingly, there is an acute need for improved devices and methods useful for storing perishable items, particularly devices and methods allowing increasing the effective storage time. To the best of the inventors' knowledge, such improved devices and methods have not been provided in the art. The present application provides some of such improved methods and devices.

SUMMARY

According to one aspect of the invention, a portable storage apparatus for storing perishable items at a reduced temperature and under a reduced pressure is provided, the apparatus including an outer container having a sealed cavity formed in the wall, where the cavity is maintained under a reduced pressure; an inner container that is being cooled from outside and which provides the storage space for storing perishable items; and a vacuum pump for creating reduced pressure within the storage space.

According to another aspect of the invention, a method for storing perishable items is provided, the method comprising placing the items to be stored in the above-mentioned apparatus which has been cooled, and creating the reduced pressure within the storage space.

DETAILED DESCRIPTION

According to embodiments of the present invention, various devices, apparatuses and systems are provided for storing perishable items at a reduced temperature and under a reduced pressure. A combination of a reduced temperature and a reduced pressure is designed to improve the storage conditions and to prolong the period of time during which the items may be safely stored and maintained. The devices of the present invention may be generally described with the reference to FIGS. 1-3 showing, but not limited to, certain exemplary embodiments of the invention.

Figure 1:
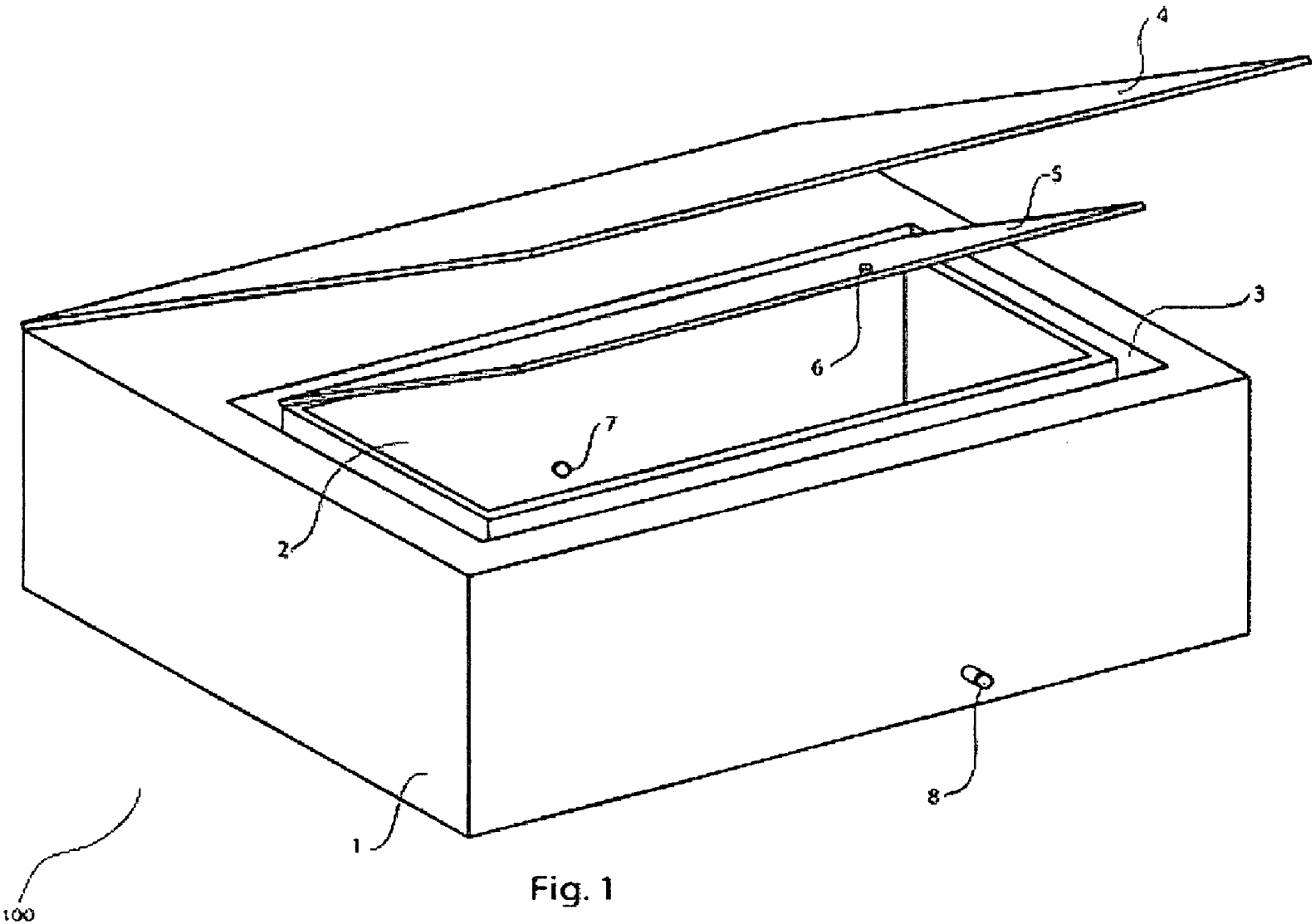
FIG. 1 depicts schematically a portable storage apparatus according to an embodiment of the present invention.

More specifically, FIG. 1 depicts schematically a portable apparatus 100 for storing perishable items. The apparatus 100 includes an outer container 1, an inner container 2, and a vacuum pump 9 (not shown on FIG. 1, shown on FIGS. 2 and 3). The outer container 1 may be fabricated of a suitable material such as a plastic. Those having ordinary skill in the art can select an appropriate material. Examples of plastics that may be used include polystyrene, poly(ethyleneterephthalate), or another sturdy plastic material. Other materials may be used for making the outer container 1, if desired. Finally, the outer container 1 further has a lid 4 equipped with a gasket. The lid 4 can be attached to the outer container 1 using hinges and can be opened and closed as needed.

Figure 2:
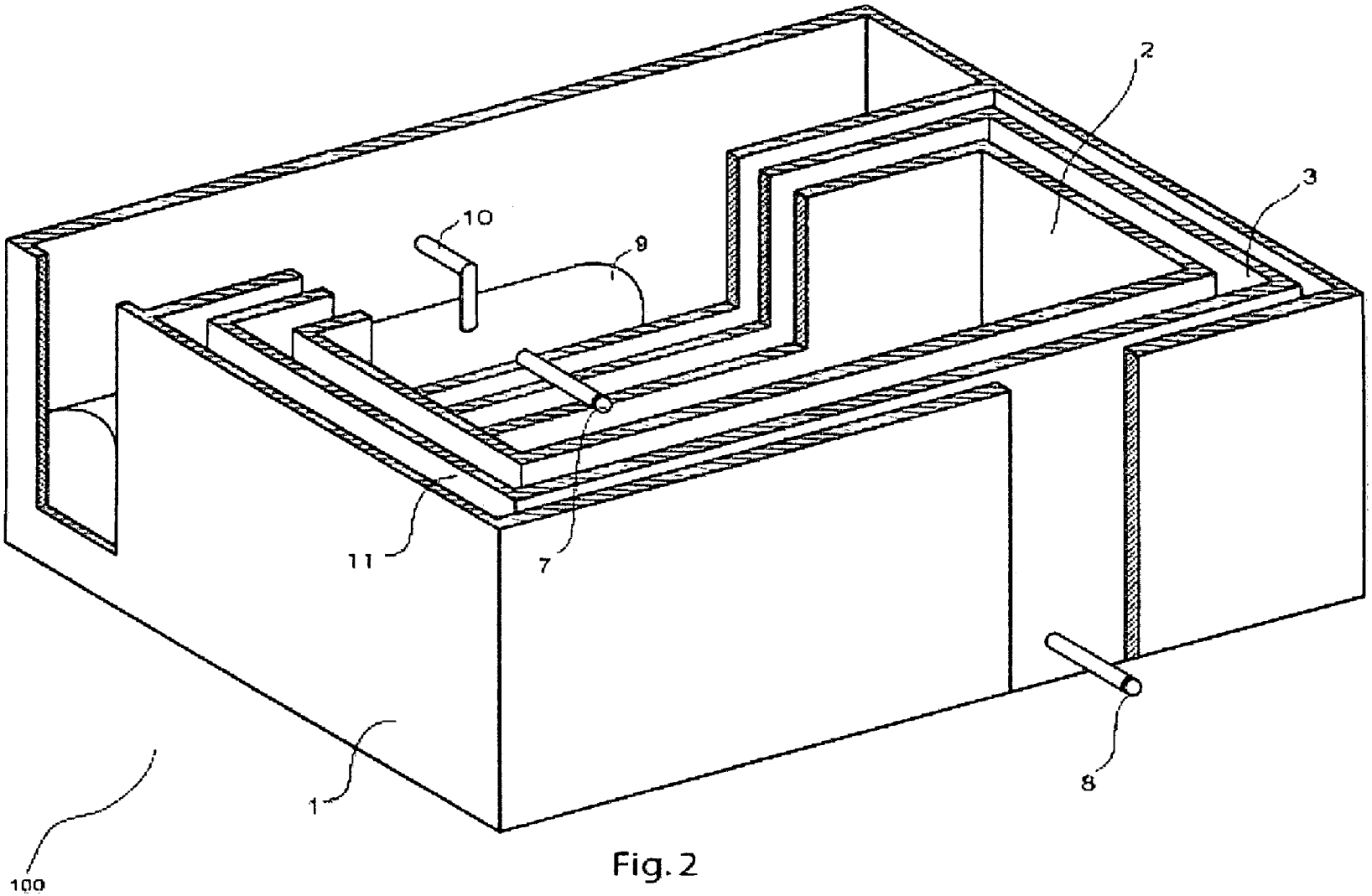
FIG. 2 is a partial cross section of a top view of a portable storage apparatus according to an embodiment of the present invention.
Figure 3:
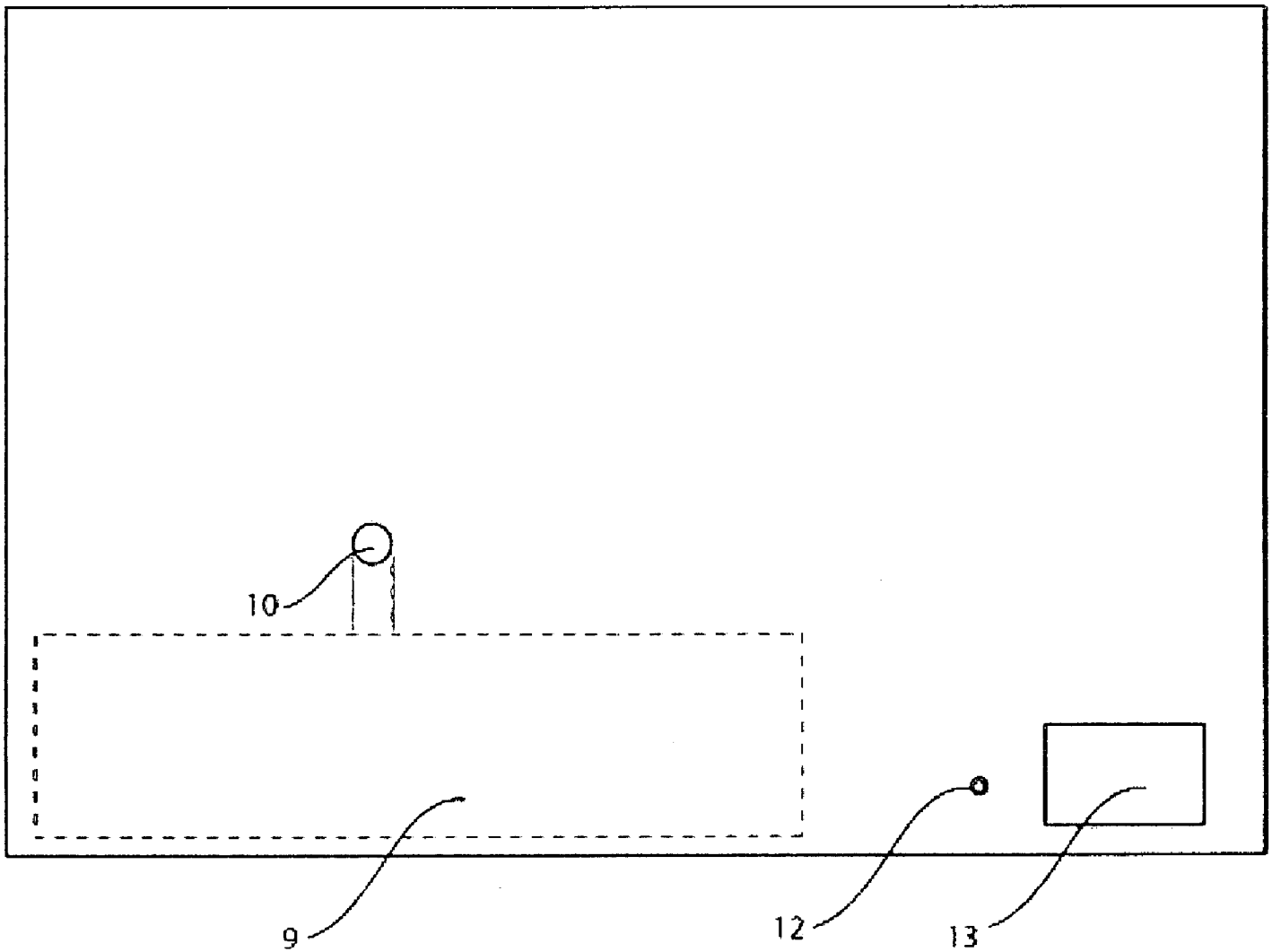
FIG. 3 is a side view of a portable storage apparatus according to an embodiment of the present invention.

As can be seen on FIG. 2, the outer container 1 includes an external wall, an internal wall and a bottom. The two walls and the bottom define an outer cavity 11. A reduced pressure is created within the outer cavity 11, and then the outer cavity 11 is sealed; for example, the outer cavity 11 may be evacuated until the pressure within it has reached the level that is between about 0.01 atmosphere and about 0.5 atmosphere, followed by sealing the outer cavity 11. The width of the outer cavity 11 may vary, for example, this width can be between about 10 millimeters and about 60 millimeters, such as between about 20 millimeters and about 50 millimeters.

The inner container 2 is placed inside the outer container 1 (FIGS. 1 and 2). The inner container 2 has a wall and a bottom. As can be seen from the illustration shown on FIG. 2, the inner container 2 is positioned as to define an inner cavity 3 between the internal wall of the outer container 1 and the wall of the inner container 2. The inner cavity 3 is intended to serve as a receptacle for a cooling medium, as discussed below. The width of the inner cavity 3 may vary, for example, this width can be between about 50 millimeters and about 100 millimeters.

The inner container 2 is intended to provide a space for the storage of the items to be cooled, and may be fabricated of a suitable material to be selected by those having ordinary skill in the art. For example, a plastic, e.g., polystyrene or poly (ethyleneterephthalate) or a metal, e.g., aluminum or stainless steel, may be used. Other materials may be used for making the inner container 2, if desired. There are no limitations on the volume of the storage space; in some exemplary non-limiting embodiments the storage space may have the volume between about 1 liter and about 50 liters.

Finally, the inner container 2 is further equipped with a lid 5, that can be attached to the inner container 2 using hinges and can be opened and closed as needed. The lid 5 is further equipped with a gasket for tighter closing, and with a valve 6, to be discussed further below.

The vacuum pump 9 is intended to create a vacuum, i.e., a reduced pressure inside the storage space of the inner container 2 using the inlet and outlet elements 7 and 10. As shown by FIGS. 2 and 3, the vacuum pump 9 is attached to the external wall of the outer container 1 and is in fluid communication with the storage space, via the inlet element 7.

The vacuum pump 9 may be of any design and kind so long as it is capable of creating the desired level of vacuum. Generally the vacuum pump 9 is capable of creating the reduced pressure within said storage space between about 0.01 atmosphere and about 0.5 atmosphere. For example, the vacuum pump 9 may be a manually operated pump or can be driven by an electric motor.

For the embodiments employing an electric motor-driven pump, the apparatus 100 may be further equipped with a charging element and outlet 12 (FIG. 3) that may be connected to a cigarette lighter charger of a car or an AC-DC converter. Alternatively, a battery pack 13 (FIG. 3) may be used for operating an electric motor driving the vacuum pump 9. Those having ordinary skill in the art will be able to select other kinds of vacuum pumps, if desired.

Optionally, a manometer (not shown) may be installed to monitor the level of pressure inside the storage space of the inner container 2. As another option, the apparatus 100 may be further equipped with a pressure adjusting device (not shown) that monitors the pressure inside the storage space of the inner container 2 and, should the pressure level rise above a desired level, automatically adjusts it by turning on the vacuum pump 9. The vacuum pump 9 can then reduce the pressure to the desired level, and shut off once that level has been reached.

The operation of the devices of the present invention may be briefly described as follows. In the apparatus 100, the items to be cooled and stored are placed inside the storage space of the inner container 2, and the lid 5 is then closed. There are no limitations on the kinds of items that can be so cooled and stored. Some examples include perishable food items (e.g., meats, fruits, vegetables, dairy products, baked goods, etc.), beverages, medical items (drugs, transplant organs, etc.), and environmental samples.

A cooling medium is then placed inside the inner cavity 3. A variety of substances can be used as the cooling medium. Depending on the desired degree of cooling, those having ordinary skill in the art may select the desired cooling medium. Non-limiting examples of the cooling media that may be used include crushed ice, cubed ice, a mixture of crushed ice with water, and combinations thereof. If it is desirable to provide storage at lower temperatures, a mixture of crushed ice with various salts may be used as the cooling medium. If even lower temperatures are desirable, dry ice (i.e., carbon dioxide in a solid form) may be employed as the cooling medium.

Once a cooling medium is in place within the inner cavity 3, the lid 4 is closed and a reduced pressure is created inside the storage space of the inner container 2 using the vacuum pump 9. Those having ordinary skill in the art can determine the level of vacuum to be employed inside the storage space of the inner container 2. For many uses, the pressure that is between about 0.01 atmosphere and about 0.5 atmosphere may be used within the storage space.

When there is a need to retrieve an item from the inner container 2, the lids 4 and 5 may be opened. To open the lid 5, the valve 6 is engaged first allowing the user to bring the pressure within the storage space to the level of ambient pressure. After the item has been retrieved, the lids 4 and 5 may be closed again, the reduced pressure can be re-created inside the storage space of the inner container 2 using the vacuum pump 9 to continue storing the remaining items.

The above-described opening-closing cycle may be repeated as many times as necessary. Finally, when the cooling medium such as ice has melted, the inner cavity 3 may be drained and emptied of a resulting liquid using the drainage opening 8. After the inner cavity 3 has been emptied, the drainage opening 8 may be stopped and the cooling medium may be replenished.

Although the foregoing invention has been described in some detail by way of illustration and example for purposes of clarity and understanding, it will be apparent to those of ordinary skill in the art in light of the teaching of this invention that certain changes and modifications may be made thereto without departing from the spirit or scope of the appended claims.

We claim:

1. A portable apparatus for storing perishable items, the apparatus consisting of two containers, an outer container and an inner container, and two lids, the first lid being attached to the outer container and the second lid being attached to the inner container, wherein:

(a) the outer container has an external wall, an internal wall and a bottom, said external and internal walls defining an outer cavity therebetween, and is further equipped with one hingedly installed openable first lid attached to said external wall, wherein said outer cavity is sealed and maintained under a reduced pressure;

(b) the inner container is disposed inside said outer container, said inner container having a wall, a bottom, and further equipped with one hingedly installed openable second lid attached to said wall, wherein said inner container is positioned as to define an inner cavity between said internal wall of the outer container and said wall of the inner container, wherein said wall and bottom of said inner container define a storage space for storing said perishable items; and (c) a vacuum pump for creating a reduced pressure within said storage space, wherein said vacuum pump is attached to said external wall of said outer container and is in fluid communication with said storage space, wherein said second lid is further equipped with a valve allowing to bring said reduced pressure created by said vacuum pump to the level of ambient pressure.

2. The apparatus of claim 1, wherein said outer container is fabricated of a material selected from the group consisting of a plastic.

3. The apparatus of claim 1, wherein said inner container is fabricated of a material selected from the group consisting of a plastic and a metal.

4. The apparatus of claim 3, wherein said metal is stainless steel or aluminum.

5. The apparatus of claim 1, wherein said outer cavity has the width between about 10 millimeters and about 60 millimeters.

6. The apparatus of claim 1, wherein said inner cavity has the width between about 50 millimeters and about 100 millimeters.

7. The apparatus of claim 1, wherein said storage space has the volume between about 1 liter and about 50 liters.

8. The apparatus of claim 1, wherein said reduced pressure within said outer cavity is between about 0.01 atmosphere and about 0.5 atmosphere.

9. The apparatus of claim 1, wherein said vacuum pump is capable of creating the reduced pressure within said storage space between about 0.01 atmosphere and about 0.5 atmosphere.

10. The apparatus of claim 1, wherein said vacuum pump is operated by electrical means or mechanical means.

11. A method for storing perishable items, comprising:

(a) providing an apparatus of claim 1;

(b) placing said perishable items inside said storage space;

(c) closing said second lid;

(d) placing a cooling medium inside said inner cavity; and (e) using said vacuum pump, creating said reduced pressure within said storage space, to store said perishable items thereby.

12. The method of claim 11, further comprising:

(f) opening said second lid by operating said valve to bring the reduced pressure within said storage space to the level of ambient pressure; and (g) retrieving said perishable items.

13. The method of claim 11, wherein the reduced pressure within said storage space is between about 0.01 atmosphere and about 0.5 atmosphere.

14. The method of claim 11, wherein the cooling medium is selected from the group consisting of crushed ice, cubed ice, a mixture of crushed ice with salt, a mixture of crushed ice with water, dry ice, and combinations thereof.

* * * * *